United States Patent [19]

Böhme et al.

[11] 4,445,615

[45] May 1, 1984

[54] SORTING SYSTEM CALIBRATION

[75] Inventors: Rolf C. Böhme, Kyalami; Max M. Lazerson, Northcliff, both of South Africa

[73] Assignee: 501 General Mining Union Corporation Limited, South Africa

[21] Appl. No.: 212,514

[22] Filed: Dec. 3, 1980

[30] Foreign Application Priority Data

Dec. 4, 1979 [ZA] South Africa ..... 79/6566
Jul. 15, 1980 [ZA] South Africa ..... 80/4247

[51] Int. Cl.[3] ..... B07C 5/346

[52] U.S. Cl. ..... 209/555; 209/586; 209/589; 250/252.1

[58] Field of Search ..... 209/552, 555, 556, 558, 209/576, 577, 586, 589; 250/252, 282, 359, 252.1; 364/460, 555, 564, 571, 579

[56] References Cited

U.S. PATENT DOCUMENTS

| | | | |
|---|---|---|---|
| 3,075,641 | 1/1963 | Hutter et al. | 209/589 X |
| 3,242,342 | 3/1966 | Gabar | 209/552 X |
| 3,282,116 | 11/1966 | Jones | 209/555 X |
| 3,588,480 | 6/1971 | Unger et al. | 364/564 |
| 3,712,469 | 1/1973 | Dwyer et al. | 209/586 X |
| 3,832,549 | 8/1974 | Mangan et al. | 250/252 X |
| 3,987,391 | 10/1976 | Hogg | 364/571 X |
| 4,194,634 | 3/1980 | Kelly | 209/589 |
| 4,246,098 | 1/1981 | Conway et al. | 209/589 |
| 4,317,521 | 3/1982 | Clark et al. | 209/589 X |
| 4,320,841 | 3/1982 | Gordon et al. | 209/589 X |

FOREIGN PATENT DOCUMENTS

| | | | |
|---|---|---|---|
| 1575850 | 6/1969 | France | 209/586 |

*Primary Examiner*—Robert B. Reeves
*Assistant Examiner*—Edward M. Wacyra
*Attorney, Agent, or Firm*—Scully, Scott, Murphy & Presser

[57] ABSTRACT

A method of eliminating errors in the radiation count of a scintillation detector in radiometric sorting caused by one or more adjacent particles. The spacing between the adjacent particles are determined, and statistically determined calibration factors are applied to the count to compensate for the adjacent particles. The calibration factors are dependent upon the spacings, the counts associated with the adjacent particles, and optionally on the shape, volume, mass and height of the adjacent particles.

5 Claims, 14 Drawing Figures

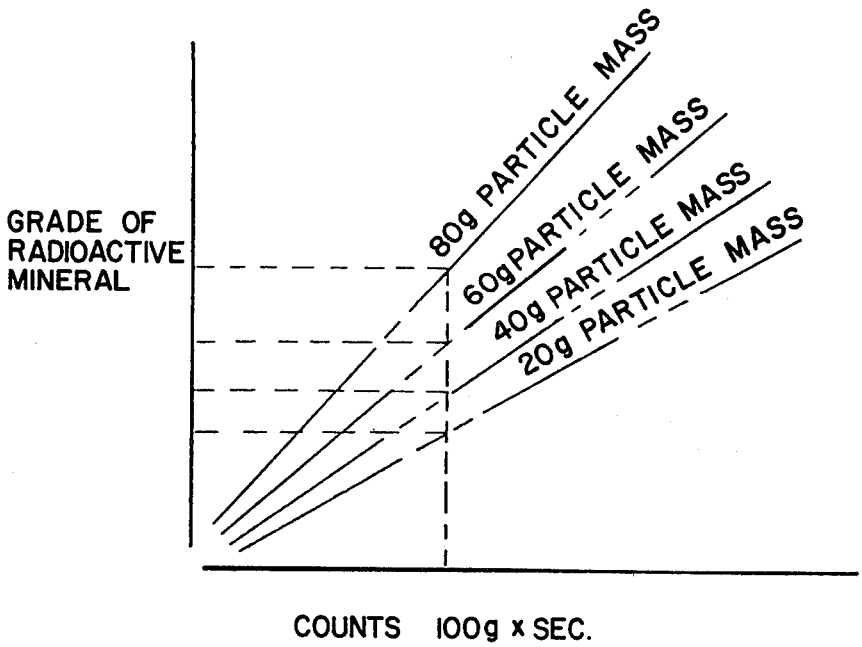
FIG 7
FIG 8
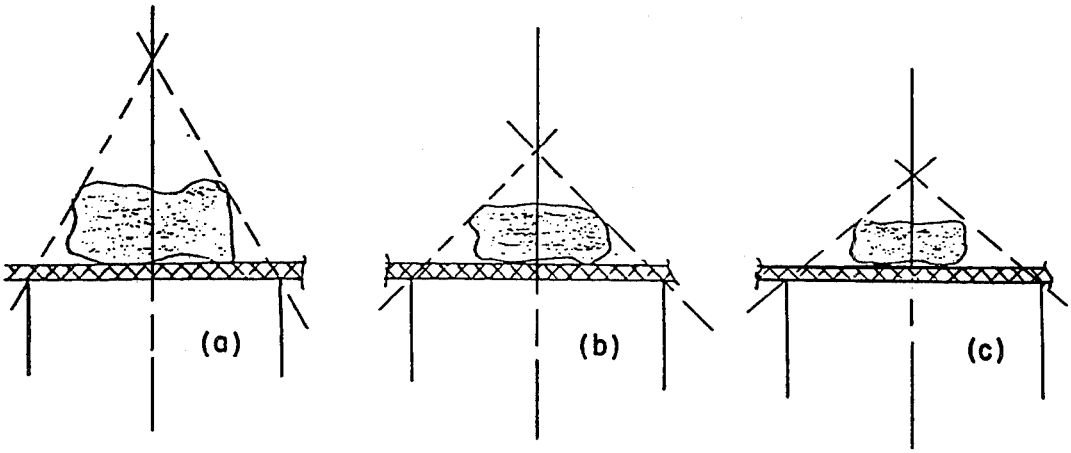
PARTICLES WITH EQUAL COUNTS & DIFFERENT MASSES

PARTICLES OF EQUAL MASS & EQUAL AMOUNTS OF RADIOACTIVE MATERIAL

SORTING SYSTEM CALIBRATION

FIELD OF THE INVENTION

This invention relates to a sorting system wherein a plurality of particles are caused to move sequentially past at least one detector which is responsive to a desired property in the particles.

BACKGROUND TO THE INVENTION

In a radiometric sorting system ore particles are arranged in parallel streams with the particles in each stream separated from each other.

The particles in each stream are passed over a plurality of spaced scintillation detectors and each detector records a radioactive count for each particle as it passes. The counts from the individual detectors pertaining to the same particle are then accumulated to obtain a final determination of the radioactive content of the particle and a particle accept or reject decision is based on this determination.

With large spacings between adjacent particles this method functions adequately but as the spacings decrease the accumulated count derived for a given particle, (P), is influenced by fringing effects arising at least from a preceding particle (P−1), and a following particle (P+1).

Due to the continuous and random nature of the emission of radiation from radioactive material, when the particle (P) is within the gated counting zone of a particular scintillation detector, particles (P−1) and (P+1) are also emitting radiation which is also seen and counted by the detector and associated counting electronics as being due to particle (P). The result is that if either particle (P−1) or (P+1) is of fairly high grade ore, and particle (P) is of waste or low grade ore, particle (P) may have an apparent high count and consequently be incorrectly sorted by the machine as ore, when it is actually waste, the final result being to dilute the accept ore fraction. This effect is unavoidable at the particle to detector distances required for adequate sensitivity and the inter-particle spacing required to give commercially acceptable feed rates. This effect is further compounded by the additional effects of particles (P−2) and (P+2), but these are second order effects and may be ignored.

For example, in practice, for 37 mm particles, a particle (P+1) of grade 0.5 gm/ton preceding a 37 mm waste particle (P) with a spacing of 100 mm will result in the particle (P) being seen as 0.12 kgm/ton and for an accept machine setting of 0.1 kgm/ton consequently being spuriously accepted. This ignores the additional effect of a following ore particle which may further increase the apparent grade of the particle (P). This effect increases rapidly with larger particles and smaller separations.

SUMMARY OF THE INVENTION

According to the invention there is provided a method of sorting which includes the steps of causing a plurality of particles to move sequentially past at least one detector which is responsive to the presence of a desired property in the particles, for each particle, producing from the detector's response an output signal which is dependent on the degree to which the desired property is present in the particle, determining the spacing between the particle and at least one adjacent particle, and applying to the output signal at least one calibration factor which is dependent at least on the spacing and on the output signal of the adjacent particle.

Further according to the invention the particles are caused to move sequentially past a plurality of detectors and the output signal for each particle is produced at least by accumulating the separate responses of the detectors to the particle.

The calibration factor may be dependent on at least one of the shape, volume, mass or height, of the adjacent particle.

Further according to the invention the calibration factor represents the contribution to the said output signal caused by the adjacent particle, the calibration factor being subtracted from the output signal of the said particle.

Further according to the invention the spacings between each particle and the adjacent preceding and following particles respectively are determined, and two calibration factors dependent on the said spacings and on the output signals of the adjacent preceding and following particles respectively are applied to the output signal of the said particle.

BRIEF DESCRIPTION OF THE DRAWINGS

The invention is further described by way of example with reference to the accompanying drawings in which:

FIG. 7 illustrates graphically the relationship of radioactivity grade to radioactive count for particles of different masses, FIGS. 8 (*a*), (*b*) and (*c*) illustrate particles of different masses exposed to scintillometers, FIGS. 9 (*a*), (*b*) and (*c*) illustrate particles with different shapes, but which are equal in mass and which have equal amounts of radioactive material, exposed to scintillometers.

DETAILED DESCRIPTION OF THE INVENTION

The invention is based on the use of a computing aid such as a microprocessor, as well as a mass, volume, dimension or shape measuring system, for example, of the types described in the applicant's co-pending applications entitled "Volumetric Measurement" and "Grade Determination" which form the subject of South African Patent Applications Nos. 80/4250 and 80/4249 respectively, which correspond respectively to U.S. patent applications Ser. No. 229,053, filed Jan. 26, 1981 now U.S. Pat. No. 4,417,817 and Ser. No. 211,444, filed Nov. 28, 1980 now U.S. Pat. No. 4,407,415, the disclosures of which are herein explained with reference to FIGS. 5 to 10 and their accompanying explanations.

The following discussion relates to a radiometric system wherein at least one stream of spaced apart ore particles are moved, e.g. by means of a conveyor belt, sequentially past a plurality of scintillometers each of which produces a radioactive count for the particular particle exposed to it at any given time.

Figure 1:
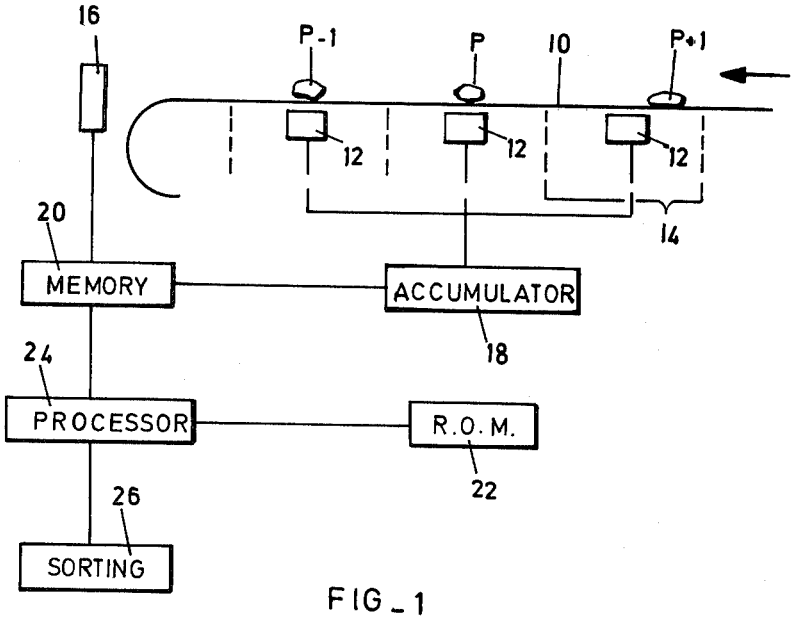
FIG. 1 is a schematic illustration of an implementation of the method of the invention.

A system of this kind is well known in the art and a schematic representation of such a system is embodied in FIG. 1. As shown in this figure a conveyor belt 10 carries a plurality of in-line particles . . . P−2, P−1, P, P+1, P+2, . . . which are mutually spaced, past a plurality of radiation detectors 12, each of which has a respective counting zone 14. The volume, mass, height or shape of each particle is determined by means of measuring apparatus 16 of the kind referred to in U.S. patent application Ser. No. 227,053, or in U.S. patent application Ser. No. 211,444, as the case may be, which is located downstream of the detectors 12.

Figure 5:
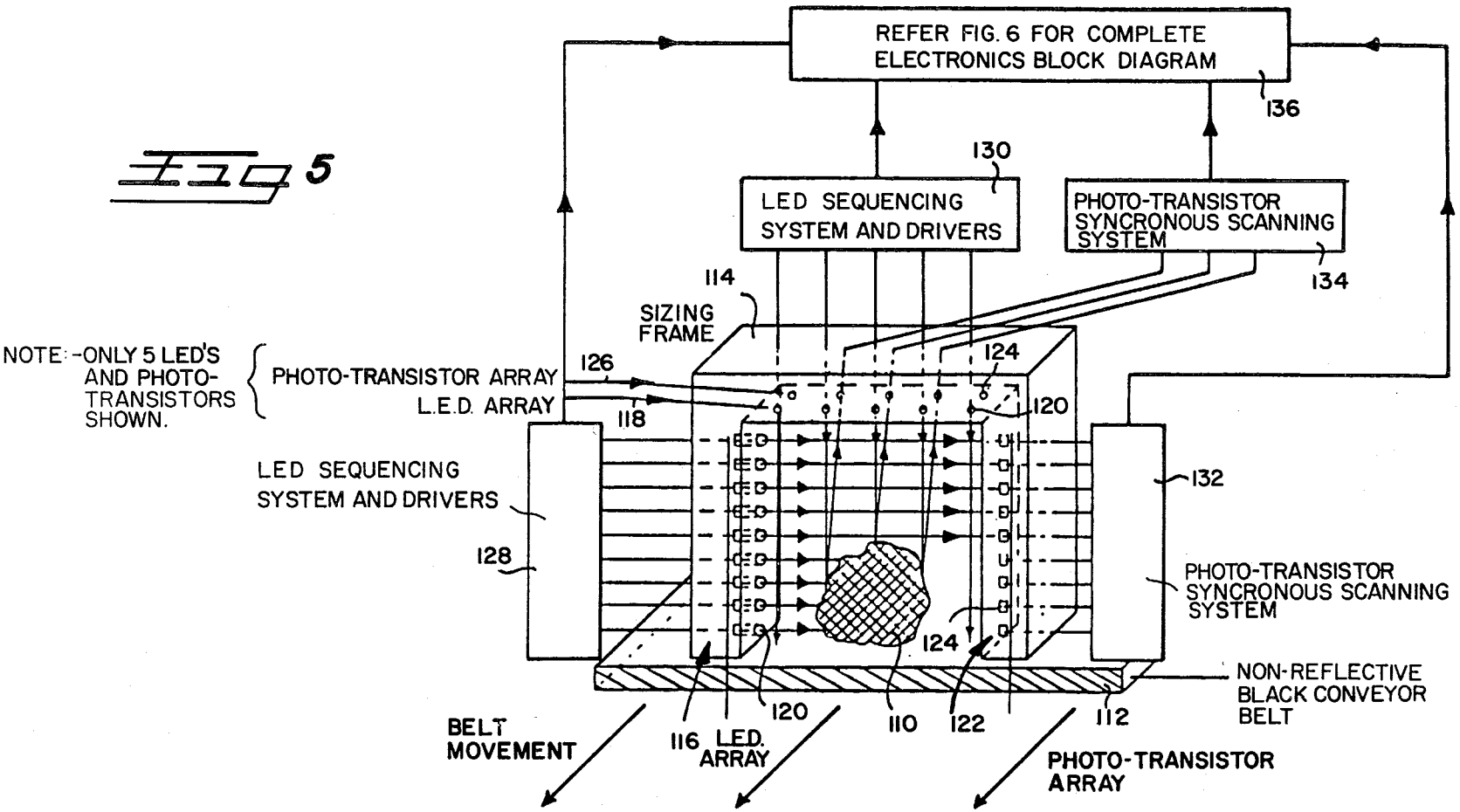
FIGS. 5 and 6 illustrate different devices for the volumetric measurement of particles.

The apparatus 16 may consist of the device shown in FIG. 5 which is designed for the volumetric measurement of a particle 110 located on a moving conveyor belt 112 which is made from a black non-reflective material. FIG. 5 illustrates only one particle but in practice the belt may carry a plurality of rows of particles with the particles in each row being spaced from one another and with the rows also being spaced from each other.

Mounted above the belt is a frame 114 having vertical and horizontal arrays 116 and 118 respectively of partially collimated high intensity pulsed light emitting diodes 120. An array 112 of highly collimated photo transistor light sensors 124 is arranged vertically on the frame opposing the array 116, with each sensor corresponding to a particular diode 120.

Similar sensors are arranged in a horizontal array 126 with each sensor being adjacent and being associated with a particular diode 120 in the array 118.

Each diode has a wider collimation angle than its associated highly collimated photo transistor, so that, with regard to the horizontal arrays 118 and 126, each photo transistor can detect light originating from its associated diode and reflected at any point above the belt surface and below the upper limb of the frame 114.

The diodes in each array 116 and 118 are sequentially pulsed by drivers 128 and 130 respectively and the corresponding arrays 122 and 126 of photo transistors are synchronously scanned by means of scanners 132 and 134 respectively. Thus each transistor is only responsive to light which is emitted by its corresponding light emitting diode.

Consequently as the particle 110 is moved by the belt past the frame successive zones of the particle, which extend transversely to its direction of travel, are illuminated and scanned. In this way, by suitable selection of the synchronous sequential pulsing and scanning rate a scan resolution of approximately 5 mm can be achieved using commercially available very small light emitting diodes and photo transistors.

Thus, by counting the number of transistors in the vertical array 122 which are not illuminated directly in each scan by the diodes in the array 116 the projected height of the particle over a zone approximately 5 mm deep is determined.

Similarly, by counting the number of transistors in the horizontal array 126 which are illuminated by light emitted by the diodes in the array 118 and the reflected from the particle the projected width of the particle over the same zone is determined.

The product of the projected height and width is a measure of the projected cross-sectional area of the portion of the particle within the zone i.e. in a direction which is transverse to the direction of travel of the particle.

The data derived in this way from the various arrays is fed to a computing circuit 136, hereinafter described with reference to FIG. 6. By suitable timing of the scanning rates the projected cross-sectional area of contiguous 5 mm deep zones or slices of the particle are determined and by summing these projected areas of the zones along the length of the particle in its direction of travel the projected volume of the particle is derived.

Figure 6:
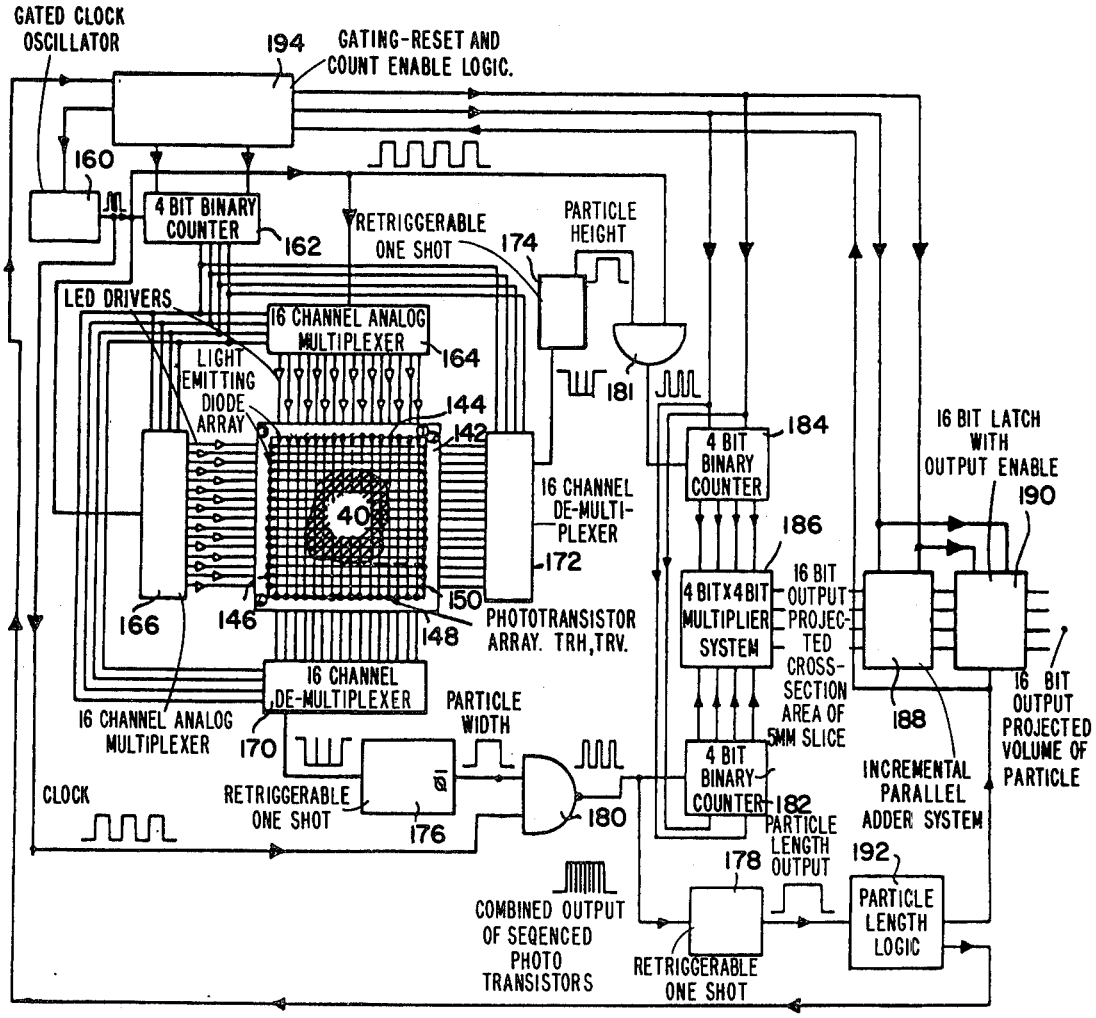

The arrangement shown in FIG. 6 is intended for the volumetric measurement of a particle 140 projected in free flight from the end of a conveyor belt through a frame 142. The frame carries arrays of light emitting diodes and photo transistors which may be identical to those of FIG. 5, i.e. arranged to be responsive to directly transmitted light and to reflected light. The arrays may alternatively be responsive to reflected light only but it is most convenient if the arrays correspond to the vertical arrays 116 and 122 of FIG. 5 i.e. the system is based on the detection of directly transmitted light.

Thus in FIG. 6 the numerals 144 and 146 denote horizontal and vertical arrays respectively of light emitting diodes, and the numerals 148 and 150 denote corresponding horizontal and vertical arrays respectively of photo transistor sensors.

In other respects the operation of the arrangement is analogous to that of FIG. 5 and will not be elaborated on for, as before, the projected cross-sectional area of each of a plurality of contigous zones of the particle is obtained, with the zones extending successively in the direction of travel of the particle, and these areas are summed to obtain a measure of the projected volume of the particle.

Consequently the following description is largely confined to a discussion of the manner in which the circuitry, designated generally as 136 in FIG. 5, works.

The circuitry includes a clock oscillator 160, a four-bit binary counter 162, two 16-channel analog multiplexers 164 and 166 associated with the horizontal and vertical arrays of diodes respectively, high power driver circuits 168, two corresponding 16-channel demultiplexers 170 and 172 respectively, retriggerable one-shots (astable multivibrators) 174, 176 and 178, AND gates 180 and 181, four bit binary counters 182 and 184, a multiplier 186, a parallel adder 188, a latch 190 and logic units 192 and 194 respectively. The latter logic unit is used for gating, reset, and count enable, logic. The former unit is used to detect the length of the particle in its direction of travel. The clock oscillator 160 drives the 4-bit binary counter 162. The 4-bit output of the binary counter 162 is decoded by the 16 channel analog multiplexer 166 which sequences the diodes in the vertical array 146, and by the multiplexer 164 which sequences the diodes in the horizontal array 144. The outputs of the multiplexers are fed to the high power driver circuits 168 which drive the light emitting diodes to give very high intensity light pulses.

The action of each multiplexer is sequentially to pulse the light emitting dioes in each array as described. The associated light detecting photo transistor outputs are fed in parallel to the 16 channel demultiplexers 172 in the vertical plane and 170 in the horizontal plane. As these demultiplexers are synchronously driven by the binary counter 162 the pulse sequence output of the demultiplexers corresponds to the sequential pulsing of the respective diode arrays, and a high or low logic pulse is obtained from each photo transistor depending on whether it is obscured or not.

The outputs of the demultiplexers are passed to the retriggerable one shots 176 and 174, respectively, setting the width and height of the particle. The width pulse is used to gate the clock pulse through the AND gate 180 and the height pulse gates the clock pulse through the AND gate 181. The outputs of the gates are passed to the counter 184 for the vertical plane, and to the counter 182 for the horizontal plane.

The gating-, reset- and count enable logic section 194 resets the binary counters at the beginning of each scan, and stops the binary counters at the end of each scan cycle.

Thus at the end of each scan cycle a count corresponding to the number of photo transistors obscured in the vertical plane is stored in the binary counter 182 and a count corresponding to the number of photo transistors obscured in the horizontal plane is stored in the binary counter 184. The binary outputs of these counters are fed to the 4-bit×4-bit multiplier system 186, and the 16 bit output of this multiplier, corresponding to the projected cross-sectional area of a 5 mm long slice of the particle is passed to the incremental parallel adder system 188. The incremental adder system is reset to zero by the gating-reset- and count enable logic system 184 when an incoming particle is first detected by the photo transistors, and a 16-bit multiplier product representing the cross-sectional area of a 5 mm slice is then added incrementally, or accumulated, at the end of each sequential scan of the particle, the total summation over the length of the particle thus being the projected volume of the particle. After the end of the particle has been detected by the particle length logic unit 192, the output latch 190 is enabled and the output of this latch representing the projected particle volume is then available for further processing as required.

The circuit elements and arithmetic and logic blocks shown in FIG. 6 are all standard circuit elements well known to those skilled in the digital electronic art, so full circuit details are not given. The system shown comprises a 16 element array, with a corresponding electronic system, but this array can obviously be expanded to arrays with more elements.

The systems as described provide a volumetric measurement, in the nature of a measurement of the projected volume, of each particle. If desired an empirical factor can be applied to determine the mass of the particle.

Due to the physical dimensions of the light emitting diodes the measurements of the particle size are taken in steps of approximately 5 mm. This is adequate for large particles e.g. in excess of 25 mm, but inadequate for particles of the order of 10 mm. For these particles measurements have to be taken in discrete steps of the order of 1 mm.

A resolution of this magnitude may be achieved with the aid of a scanning camera, or other optical system, in the nature of that described in the applicants' co-pending South African application No. 80/3656.

With the scanning camera and a second set of mirrors, a measurement at 45° to the first one can be taken that time later that it takes for the particle to move to the next set of mirrors. This means that a second set of readings can be taken and used to compute the volume more accurately. The less of the two readings is taken to compute the volume.

The apparatus 16 may alternatively comprise means for determining the shape of a particle and its effect on radioactivity measurements, as described hereinafter with reference to FIGS. 7 to 10. FIG. 7 is substantially self-explanatory and underlines the fact that particles with different masses which produce equal radioactivity counts are not necessarily of the same grade and consequently, each particle's mass must be accurately determined if its grade is to be correctly computed.

Generally the volume of each particle is determined for example as described in the applicant's co-pending South African applications entitled "Volumetric Determination of Articles to be Sorted" and "Volumetric Measurement", or in any other suitable manner, and the mass of each particle is assumed to be directly proportional to its volume.

The correctness of this step is based on the assumption that the densities of the respective particles are, within reasonable limits, the same. It has been established empirically, however, that the specific density of particles from certain ores varies widely e.g., from 2.12 to 3.18 and, in addition, that in many instances the density of a particle is dependent on its shape. Thus in accordance with one aspect of the invention a particle is categorized according to its shape and a correction factor which takes into account shape—dependent density variations are applied to the volumetric measurement of the particle.

One way in which the particles are categorized according to shape is explained hereinafter.

It is established practice in the art of ore sorting to employ electronic computational aids, e.g., microprocessors, to process data to arrive at the accept or reject decision for each ore particle and the efficient use of a microprocessor is within the scope of one skilled in the art. Consequently the routine programming of the microprocessor will not be elaborated on. It should be evident, though, that the microprocessor can readily be programmed to process the determined volume so as to give a statistically corrected mass.

FIGS. 8 (*a*), (*b*) and (*c*) illustrate particles of different masses in each case directly overlying a scintillometer. The particles produce equal radioactivity counts and therefore are of different grades.

These Figures also make it clear that the size of a particle influences the radioactive count. In each Figure the angle subtended by the active area of the scintillometer which just grazes the perimeter of the particle is shown by means of dotted lines. It is noticeable that the angle decreases with increasing particle size and that consequently the radiation detected is dependent on the geometry of the detector, and on the particle size. In addition there is a loss of counts due to self absorption of radiation within the particle and this is related to particle size.

A correction factor which takes account of a particle's size i.e., its mass, may be applied to its radioactivity count to arrive at a corrected grade measurement. The correction factors are obtained as follows:

A large number of particles with masses varying from the minimum handled by the sorting system to the maximum handled by the sorting system, preferably with uniform reproducible shapes, and with a content of concentrations or grades normally handled by the sorting system, are individually counted under standard conditions simulating the counting system of the sorter. These particles are then individually assayed for radioactive material content by chemical or other means and from the data a series of calibration curves of counts per second per gram particle mass against particle grade are drawn up for a series of different particle mass groups.

From these calibration curves correction factors for the appropriate particle mass groups are derived to compute the particle grades more accurately on the sorting machine. The computation of grade for each particle passing through the sorting machine is done by means of a microprocessor system and the appropriate factors to compute the grade including the necessary correction factors, are entered into the Random Access Memory of the Microprocessor to be used in the computation programme as required.

Figure 10:
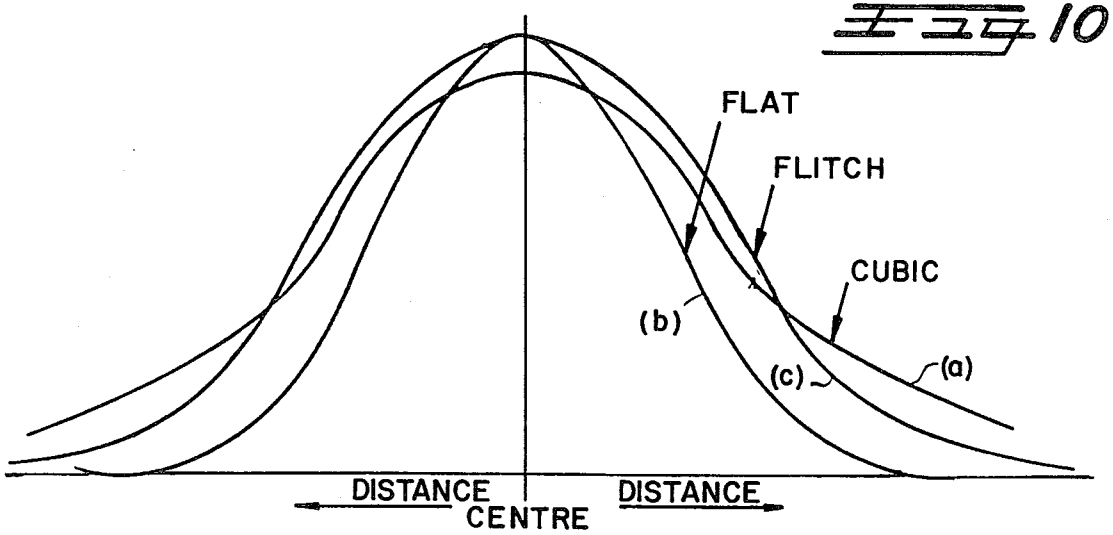
FIG. 10 illustrates the relationship of radioactive count as a function of horizontal distance from a scintillometer for three particles of different shapes.
Figure 9:
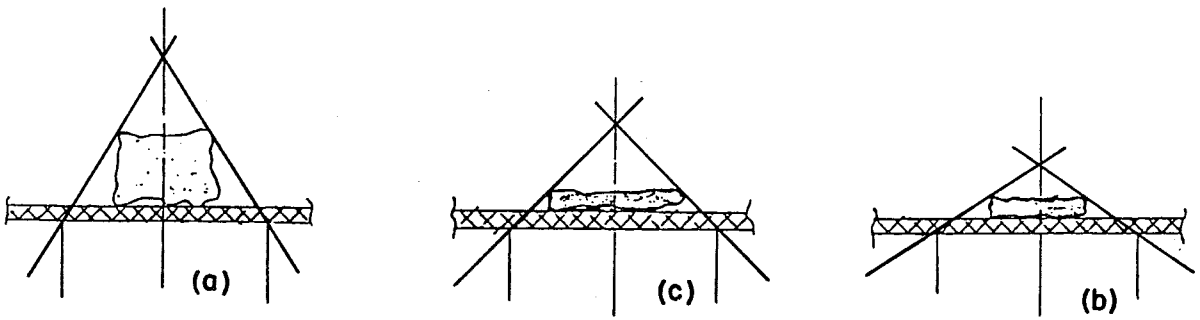

FIGS. 9 (*a*), (*b*) and (*c*) illustrate the geometry for particles of equal mass and equal radioactivity but with shapes denoted cubic, flat or flitch, which terms are hereinafter defined, and FIG. 10 illustrates the counts for these particles as a function of distance from the scintillometer centre.

The flat and the flitch particles, which are shown in FIG. 9 as having roughly the same thickness, have the same count when directly at the centre of the scintillometer. The cube, however, because of its greater self absorption, has a lower maximum count.

The count for the flat tapers off more rapidly than for the flitch; this is because the flitch is longer than the flat and a relatively greater proportion of it is exposed to the scintillometer as it is displaced from the scintillometer than what is the case for the flat.

The count for the cube tapers off the least rapdily. This is because the scintillometer is responsive to radiation from the upper portions of the cube, because of its greater height, when the cube is displaced from the scintillometer whereas for the flat and the flitch particles a displacement from the scintillometer rapdily takes the particle beyond the range of the scintillometer.

The different shapes result from the geological characteristics of the ore which during mining and subsequent crushing breaks along its weakest planes.

For this application the different particle shapes have been limited to three which are defined as follows, where a=length i.e., the greatest linear dimension of a particle, b=width i.e., the maximum linear dimension of the particle at right angles to its length.

c=height i.e., the maximum linear dimension of the particle at right angles to its length and width.

"cubic": $a>b>\frac{1}{2}a$ and $a>c>\frac{1}{2}a$

"flat": $a>b>\frac{1}{2}a$ and $c<\frac{1}{2}a$

"flitch": $b<\frac{1}{2}a$ and $c<\frac{1}{2}a$

It has been found that certain ores contain 60% "cubics", 30% "flats" and 10% "flitches". The definitions of the shapes have been given in this example in terms of maximum linear dimensions but this is not necessarily so and the definitions could be formulated in terms of average linear dimensions.

The possible shapes are by no means exhaustive and for certain ores it may be possible to recognize more or fewer basic shapes. The important point is that each basic shape has a predictable effect, within limits, on the radiation count.

By means of fundamental measuring techniques and through the use of a number of statistically representative particle samples of the different basic shapes, and falling in different mass categories, a series of curves similar to those in FIG. 10 can be produced and the data derived therefrom can be employed to generate correction factors which are utilized in the microprocessor program to compute statistically corrected grade determinations.

Another factor which is taken into account is that the counts on which the grade determinations are based must be taken under the same conditions for the different particles.

As the counts per unit time received by the scintillometer crystal are a function of the distance betweeen the particle and the crystal, and are a maximum when the particle passes the centre of the crystal, and as the background is not affectd by the movement of the particle, it is essential to start counting the radiation from the approaching particle when the counting rate is a fair proportion of the peak counting rate, that is when the particle is on the centre-line of the crystal.

The counting time is therefore started when the particle approaches the scintillation counter at a fixed distance from the counter, and stopped the same distance after the counter.

This can be achieved by means of a light gate at the entry of the counting zone, or by sorting the counts in a register at fixed time intervals and only withdrawing those counts from the register that have been registered when the particle was in the counting zone.

The invention provides a means of correcting for contributions in the count for a particle (P) due to a preceding particle (P−1) and due to a following particle (P+1).

In accordance with the invention the counts from each radiation detector relating to the passage of the particle (P−1) through the counting zone for each radiation detector are summed in an accumulator 18. This may be done for example in the manner described in U.S. Pat. No. 4,320,841 issued Mar. 23, 1982 to Gordon et al. The accumulated count for the particle (P−1) may also contain a component due to its preceding particle (P−2) and the particle (P), but this component is for the present ignored. Denote this accumulated count for particle (P−1) as N(P−1). N(P−1) is then stored in file in a memory 20 of the microprocessor system temporarily allocated to the particle (P−1). Denote this memory file as M(P−1). The accumulated count N(P−1) for the particle (P−1) is also used to correct the count for the particle (P−3) in the same manner as described hereunder.

The particle (P) follows the particle (P−1) through the radiation detection system, and the accumulated count N(P) for the particle (P) is stored in a file M(P) of the memory 20. Similarly, the accumulated count for the particle (P+1) is stored in a file M(P+1) of the microprocessor memory. The count contributions to particle (P) from the preceding and following particles (P−1) and(P+1) respectively are very dependent on the distance between the particles, due both to the effect of the intensity of the gamma radiation, seen by the detector, varying with the inverse square of the distance from particle to detector, and due to the effect of the absorption of radiation by the lead shielding surrounding each detector changing the effective solid angle subtended by the particle as seen by the radiation detector. The effective solid angle subtended by the particle as seen by the radiation detector is also dependent on the height or size of the particle, and for the purpose of the present invention, this is taken as being equivalent to the mass of the particle.

Therefore, in order to correct the accumulated count N(P) for the effect of counts due to the particles (P−1) and (P+1), it is necessary to determine the separations between the particle (P) and the particles (P−1) and (P+1), and also the mass of the particles (P−1) and (P+1) respectively.

A means 16 of determining the mass of each particle by measuring projected areas of the particle and processing this to give the equivalent mass is disclosed for example, in the applicant's co-pending patent application entitled "Volumetric Measurement", hereinbefore referred to as forming the subject of U.S. patent application Ser. No. 229,053. This mass information for each particle is required to calculate the concentration or grade of required material in each particle, and so is available for the purposes of this invention. Alternatively, the apparatus 16 can readily be employed simply to obtain a measure of the maximum or average height of each particle on the belt or its shape. The optical sizing or mass measurement system can also readily provide by methods obvious to persons skilled in the opto-electronic art the separation between adjacent particles, so this information is also available for the purposes of this invention. For example, the sizing and measurement system provides a measure of the linear dimensions of the particles in the direction of belt movement and with the belt speed known it is a relatively simple matter to arrive at a measure of the separation between adjacent particles. The separation measurement can be made with regard to suitable reference points, e.g. the leading edges of the respective particles, but preferably is a function of the "centre to centre" spacing of adjacent particles, with the centre being the geometric centre determined from the volumetric measurement. If the geometric centre of each particle is derived from the volume measurement, and since the particles are accurately tracked on the belt which has a known and fixed speed, it is a comparatively simple matter to calculate the spacing between particles.

The respective masses of the particles (P−1), (P) and (P+1), as derived from the volume measuring device, are then stored in the microprocessor memory files M(P−1), M(P) and M(P+1), and the spacings between the particles, as derived from the optical mass measurement system, or by other means, are also stored in the corresponding memory files M(P−1) and M(P+1). The following information regarding particles (P−1), (P) and (P+1) is then available in the microprocessor memory 20:

(a) accumulated radioactivity counts for each particle, (b) mass of each particle; or alternatively the height, shape or volume of each particle, and (c) separation distance between adjacent particles.

From statistically measured calibration factors which may be determined by means readily obvious to persons skilled in the art, a matrix of correction factors may be drawn up, and permanently stored in a read only portion 22 of the microprocessor memory.

The correction factors are determined statistically and are based on the mass, volume, height or shape of a particle, its spacing from an adjacent particle, and its own radioactivity accumulated count.

Figure 2:
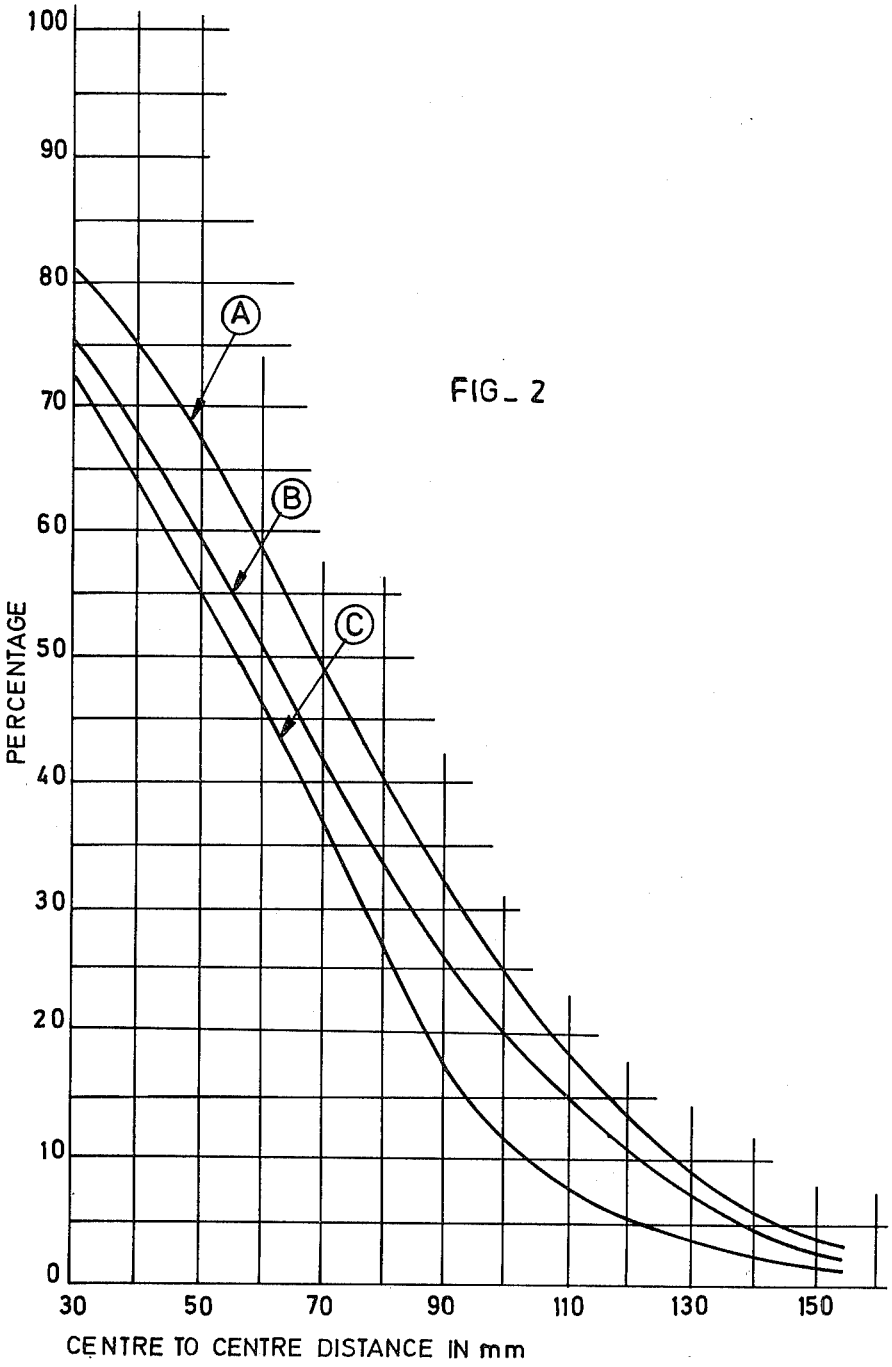
FIG. 2 illustrates a family of curves for particles of different shape from which correction factors as a function of inter-particle spacing can be derived.

FIG. 2 illustrates correction curves for particles of sizes falling within a particular size fraction as a function of shape, and centre to centre spacing of adjacent particles. Each particle can be categorised into one of a number of predetermined shapes, selected in accordance with defined characteristics such as the linear dimensions of the particle in its direction of travel, and transversely to the direction of travel in the vertical and horizontal directions, e.g. in the manner described in the applicant's U.S. patent application Ser. No. 211,444 entitled "Grade Measurement", and hereinbefore referred to. FIG. 2 illustrates curves for particles with shapes designated, for the sake of convenience, as shapes A, B and C, respectively.

These curves are used as follows. Referring for example to the curve for shape A it will be seen that for a centre to centre spacing of 40 mm 75% of the total radioactivity count of a preceding or a following particle, i.e. (P−1) or (P+1) is recorded by the detector over which particle (P) is passing. The count contribution caused by the preceding or following particle diminishes rapidly with increasing particle separation and drops to below 10% with a particle separation of 130 mm.

Clearly, the curves for particles of shapes B and C are used in the same way.

Figure 3:
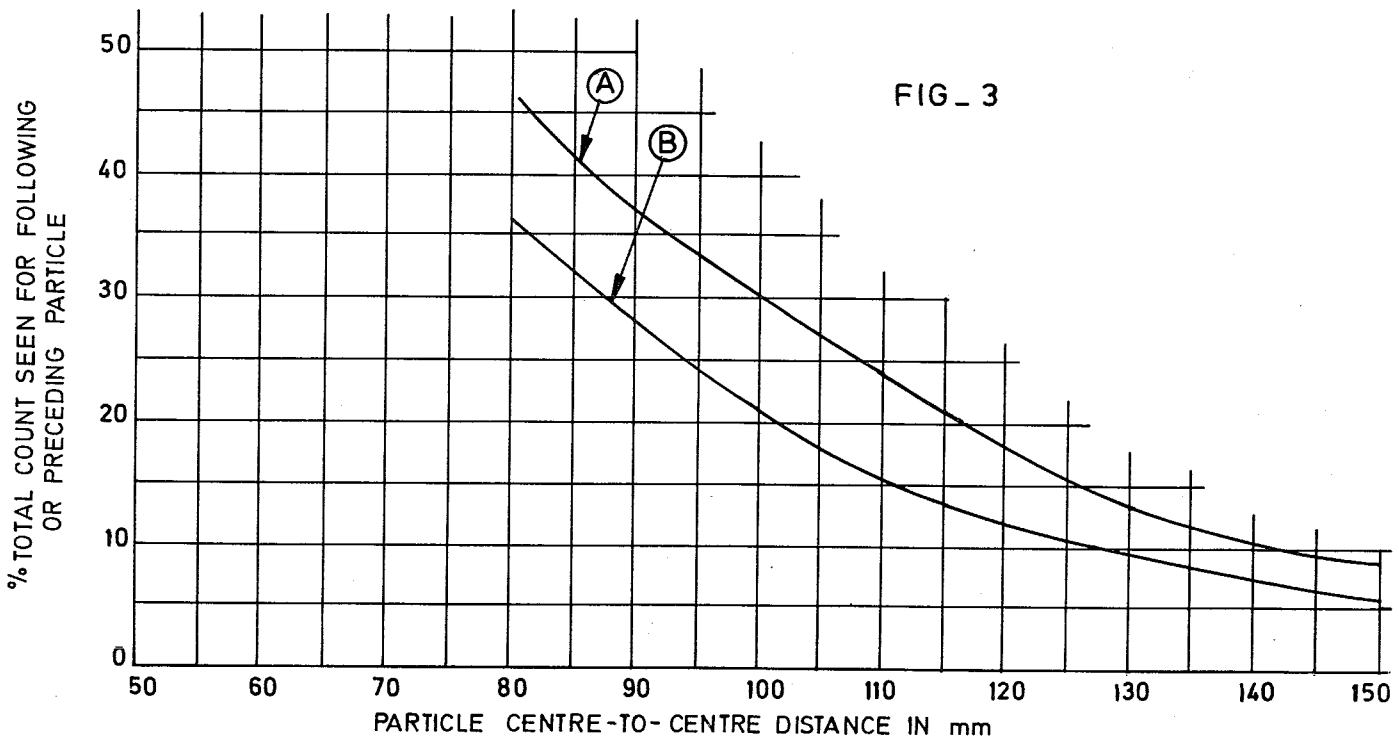
FIG. 3 illustrates in a similar manner to FIG. 2 correction curves for particles of the same mass, but of different heights.

The curves of FIG. 3 are similar but give correction factors as a function of height, and centre to centre spacing, for particles of the same mass. Curve A relates to a 150 gm spherical particle with a height of 50 mm, while curve B relates to a particle of equal mass which is an irregular cube but 25 mm high. Clearly, for a given particle spacing, the effect of a following or preceding particle will be a function of its height as the "fringing effect" increases with height.

For example, at a spacing of 100 mm a particle of type A whether preceding or following contributes 30% of its total count to the count of the particle actually under test, while a particle of type B contributes approximately 22% of its total count.

It is apparent that a very large number of possible correction curves could be compiled to cater for practically all variations in shape, size, mass, etc, of the particles to be sorted. It is possible, however, to restrict the number of curves by statistical analysis, for example, by working with representative ore samples and by determining the percentage of particles of standard, pre-selected shapes, or falling within pre-selected size ranges.

For particles of each of the predetermined categories the percentage count contribution is then determined by measuring the radioactivity count due to each particle as its distance from a single detector is varied, and expressing this as a fraction of the total count of the particle. Measurements of this type are easily effected using standard laboratory techniques but use may alternatively be made of an analyser of the type described in the applicant's South African Patent Application No. 79/6728.

The accumulation of this data, and its processing to arrive at correction curves of the kind described, is readily within the abilities of one skilled in the art. The decision on whether to base the correction factors on height, mass, shape or volume, or some other parameter may be determined largely empirically on the basis of test runs with representative ore samples to ascertain the most efficient correction procedure. The correction factors are thereafter stored in the read only memory 22.

The count correction for the particle (P) is then implemented with the aid of a microprocessor 24 which can be appropriately programmed by those skilled in the microprocessor programming art, to read from the stored correction factor matrix file in the memory 22 a correction factor appropriate to the mass of particle (P−1) and the separation of particles (P−1) and (P), and to apply this correction factor to the accumulated counts N(P−1), to obtain a measure C(P−1) of the count contribution made by the particle (P−1) to the accumulated count N(P) of particle (P). By subtracting C(P−1) from N(P) the accumulated count for the particle (P) is derived without the count contribution from the particle (P−1). A similar correction is made for the contribution due to the particle (P+1) and thus a corrected count for the particle (P) is obtained.

Figure 4:
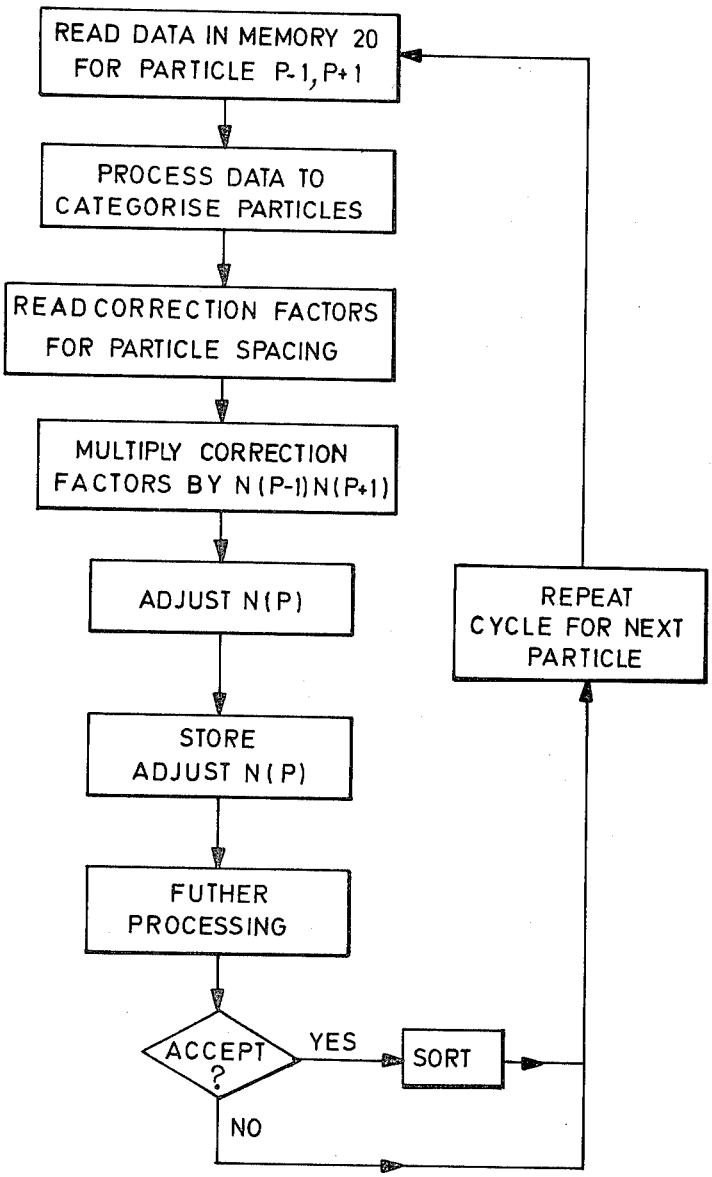
FIG. 4 illustrates in simplified form a flow chart which depicts the steps employed in a computer programme and in the method of the invention.

FIG. 4 illustrates a simplified flow chart of a suitable computer programme which enables the correction factors to be applied. The chart is largely self-explanatory and illustrates a computing cycle for a single particle. Clearly, if there are parallel rows of detectors similar computations could take place simultaneously, in parallel, or use could be made of time sharing techniques to enable all the computations to be performed by a single processor. Such considerations are, however, not relevant to an understanding of the present invention.

Theoretically, similar corrections should be applied to the particles. (P−1) and (P+1) to obtain the true counts for those particles to which the correction factor for the particle (P) should be applied, but these are second order corrections and may be ignored.

It should be pointed out that it is within the scope of the invention to effect a plurality of corrections on the count of a given particle. Thus a particle count may be significantly affected by one or more of the shape, size, i.e. volume, mass or height of a preceding or following particle, and corresponding multiple corrections may be applied to the count.

After the radioactivity count has been corrected in the manner outlined, each particle's grade can be calculated and an accept or reject decision can be made by the logic.

The particles can then be sorted by means of standard sorting apparatus 26, e.g. air blast nozzles controlled by the processor 24.

This improvement largely eliminates the spurious acceptance of waste or low grade ore particles due to the effect of following and preceding particles and the consequent dilution of the accept or high grade ore fraction.

We claim:

1. A method of sorting which includes the steps of causing a plurality of particles to move sequentially past at least one detector which is responsive to the presence of a desired property in the particles, for each particle, producing from the detector's response an output signal which is dependent on the degree to which the desired property is present in the particle, determining the spacing between the particle and at least one adjacent particle, and applying to the output signal at least one calibration factor which is dependent at least on the spacing and on the output signal of the adjacent particle.

2. A method according to claim 1 wherein the particles are caused to move sequentially past a plurality of detectors and the output signal for each particle is produced at least by accumulating the separate responses of the detectors to the particle.

3. A method according to claim 1 wherein the calibration factor is dependent on at least one of the shape, volume, mass or height of the adjacent particle.

4. A method according to claim 1 wherein the calibration factor represents the contribution to the said output signal caused by the adjacent particle, the calibration factor being subtracted from the output signal of the said particle.

5. A method according to claim 1 wherein the spacings between each particle and the adjacent preceding and following particles respectively are determined, and two calibration factors dependent on the said spacings and on the output signals of the adjacent preceding and following particles respectively are applied to the output signal of the said particle.

* * * * *